US005912646A

United States Patent [19]

Seki et al.

[11] Patent Number: 5,912,646

[45] Date of Patent: Jun. 15, 1999

[54] MULTI SECTOR ANTENNA

[75] Inventors: Tomohiro Seki; Kazuhiro Uehara; Kenichi Kagoshima, all of Kanagawa, Japan

[73] Assignee: Nippon Telegraph and Telephone Corporation, Tokyo, Japan

[21] Appl. No.: 08/842,568

[22] Filed: Apr. 15, 1997

[30] Foreign Application Priority Data

Apr. 15, 1996 [JP] Japan ..... 8-092249

[51] Int. Cl.[6] ..... H01Q 26/00; H01Q 25/00

[52] U.S. Cl. ..... 343/700 MS; 343/872; 343/890; 343/891; 343/770; 343/853; 343/893

[58] Field of Search ..... 343/700 MS, 892, 343/890, 891, 770, 853, 893; H01Q 26/00, 25/00, 1/38

[56] References Cited

U.S. PATENT DOCUMENTS 5,757,324 5/1998 Helms et al. ..... 343/700 MS
5,818,391 10/1998 Lee ..... 343/700 MS

FOREIGN PATENT DOCUMENTS

631343 A1 12/1994 European Pat. Off. ..... H01Q 21/00
6-132723 5/1994 Japan ..... H01Q 21/00
6-237120 8/1994 Japan .

*Primary Examiner*—Robert Kim
*Assistant Examiner*—Layla G. Lauchman
*Attorney, Agent, or Firm*—Nikaido, Marmelstein, Murray & Oram LLP

[57] ABSTRACT

A small sized multi sector antenna having a plurality of sectors or element antennas each having related directivity in horizontal plane so that one of the element antennas is selected for providing desired beam direction has been found. Each of the element antennas is planar or in flat disc shaped, and is, for instance, a micro-strip antenna. Each of the element antennas is located in vertical plane, and each element antenna is positioned at different height from one another so that each element antenna does not overlap with other element antennas in vertical direction. A central vertical axis of the sector antenna is defined and the element antennas are positioned with axial symmetrical relations relating to said axis.

14 Claims, 11 Drawing Sheets

Fig. 4(a)
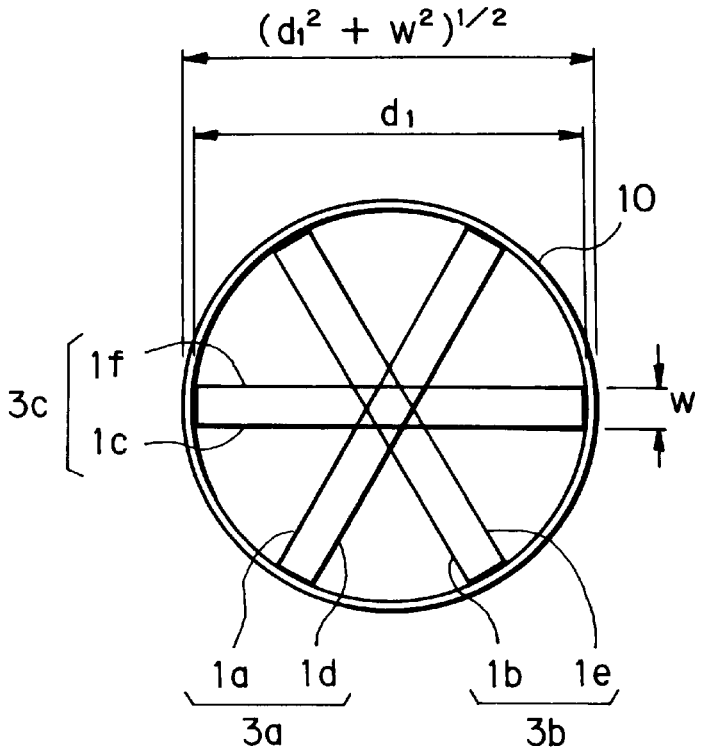
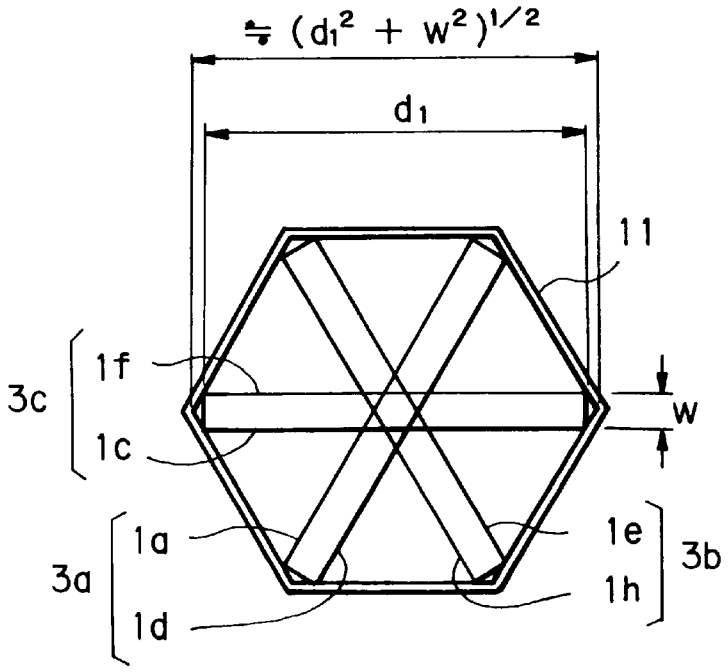
Fig. 4(b)

MULTI SECTOR ANTENNA

BACKGROUND OF THE INVENTION

The present invention relates to an antenna used wireless communication system, in particular, relates to a multi sector antenna having a plurality of element antennas so that a single beam in desired direction is radiated and the direction of a beam may be switched by selecting one of the element antennas FIG. 11 shows a top view of a prior multi sector antenna, in which the numerals 1*a* through if are an element antenna, 2*a* through 2*f* are a beam radiated by the related element antenna In a prior multi sector antenna as shown in FIG. 11, assuming that it has N number of element antennas (N=6 in the embodiment of FIG. 11), the external diameter D of the multi sector antenna, or the longest length D of the multi sector antenna in horizontal plane, is expressed as follows, where d is the horizontal length of each element antenna, and cross over level is −3 dB.

$$D \approx d/(\sin(180°/N)) \quad (1)$$

The number N is usually equal to or larger than 3.

It should be noted in the equation (1) that the external diameter D is increased when the number N of the element antennas is large Therefore, the prior multi sector antenna as shown in FIG. 11 has the disadvantage that the external diameter D is extremely large when the number N of the sectors (or element antennas) is large.

SUMMARY OF THE INVENTION

The object of the present invention is, therefore, to overcome the disadvantages and limitations of a prior multi sector antenna by providing a new and improved multi sector antenna.

It is also an object of the present invention to provide a multi sector antenna which is small in size.

It is also an object of the present invention to provide a multi sector antenna in which external diameter D is independent from number N of element antennas.

The above and other objects are attained by a multi sector antenna for radiating a single beam in desired direction, having a plurality of element antennas each having different directivity from one another in horizontal plane, comprising; each element antenna being planar, each element antenna being located in vertical plane, at least one of the element antennas being positioned at different height from that of other element antennas, a vertical axis (V) of said sector antenna being defined so that the element antennas are located with axial symmetrical relations relating to said axis.

BRIEF DESCRIPTION OF THE DRAWINGS

The foregoing and other objects, features, and attendant advantages of the present invention will be appreciated as the same become better understood by means of the following description and the drawings wherein.

DESCRIPTION OF THE PREFERRED EMBODIMENTS

Figures 10A, 10B:
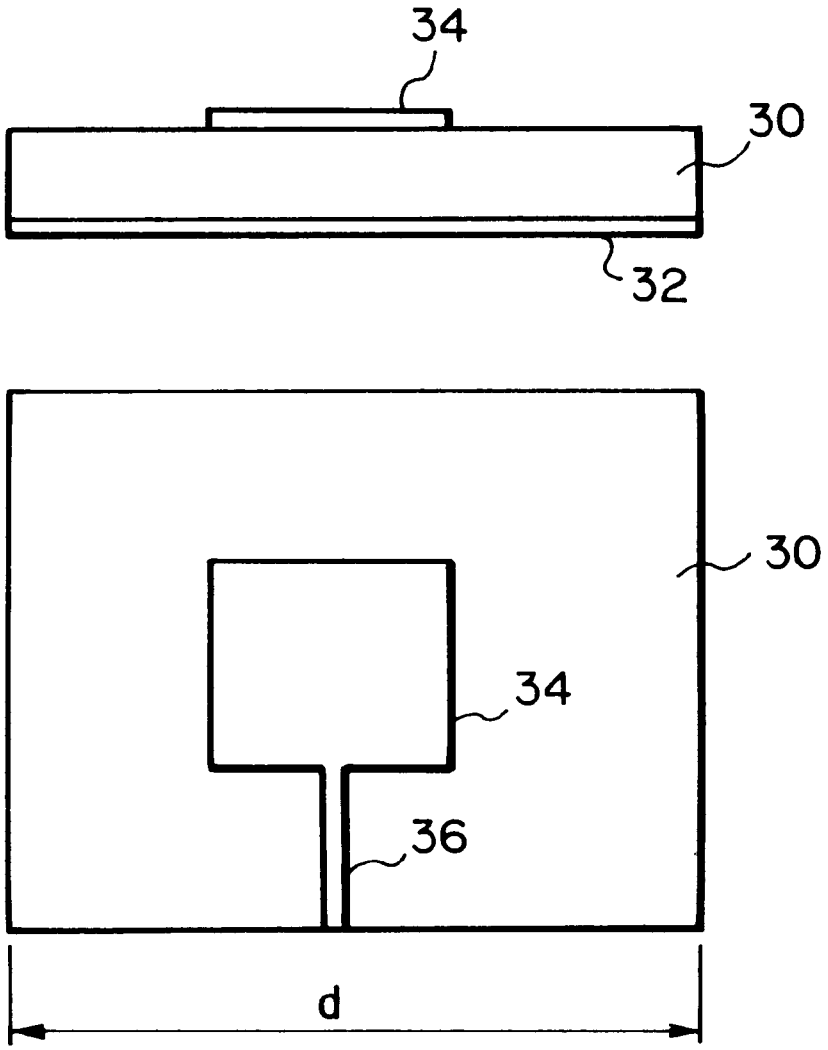
Figure 11:
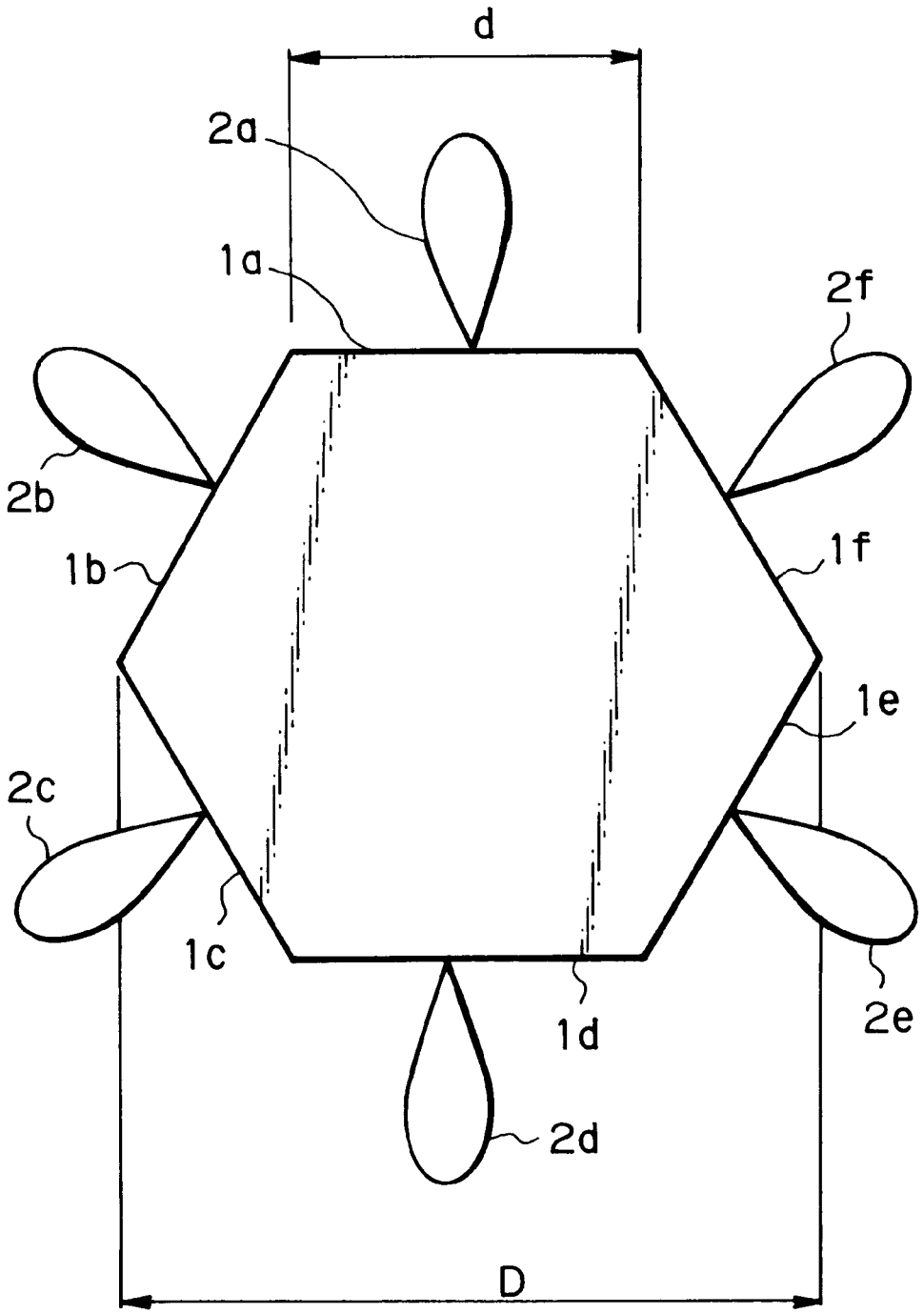
Fig. 11 PRIOR ART
FIG. 11 shows structure of a prior multi sector antenna

According to the present invention, a sector antenna has a plurality of element antennas, each having related directivity in horizontal plane, for radiating a single beam in desired direction An element antenna is planar or in flat disc shaped An element antenna is implemented by a micro-strip antenna, or a dipole antenna mounted on a flat substrate FIGS. 10(*a*) and 10(*b*) show an embodiment of an element antenna which is implemented by a micro-strip antenna. In the figure, the numeral 30 is a dielectric substrate, 32 is a ground conductor on one surface of the substrate 30, 34 is a patch on the other surface of the substrate 30, and 36 is a feed line for feeding to the patch 34. The size of the patch 34 and the substrate 30 is determined by the frequency used, and the desired beam width. The structure of a micro-strip antenna itself is conventional In the current specification, it is assumed that an element antenna is located in vertical plane, and the horizontal length of the element antenna is d.

Figure 1:
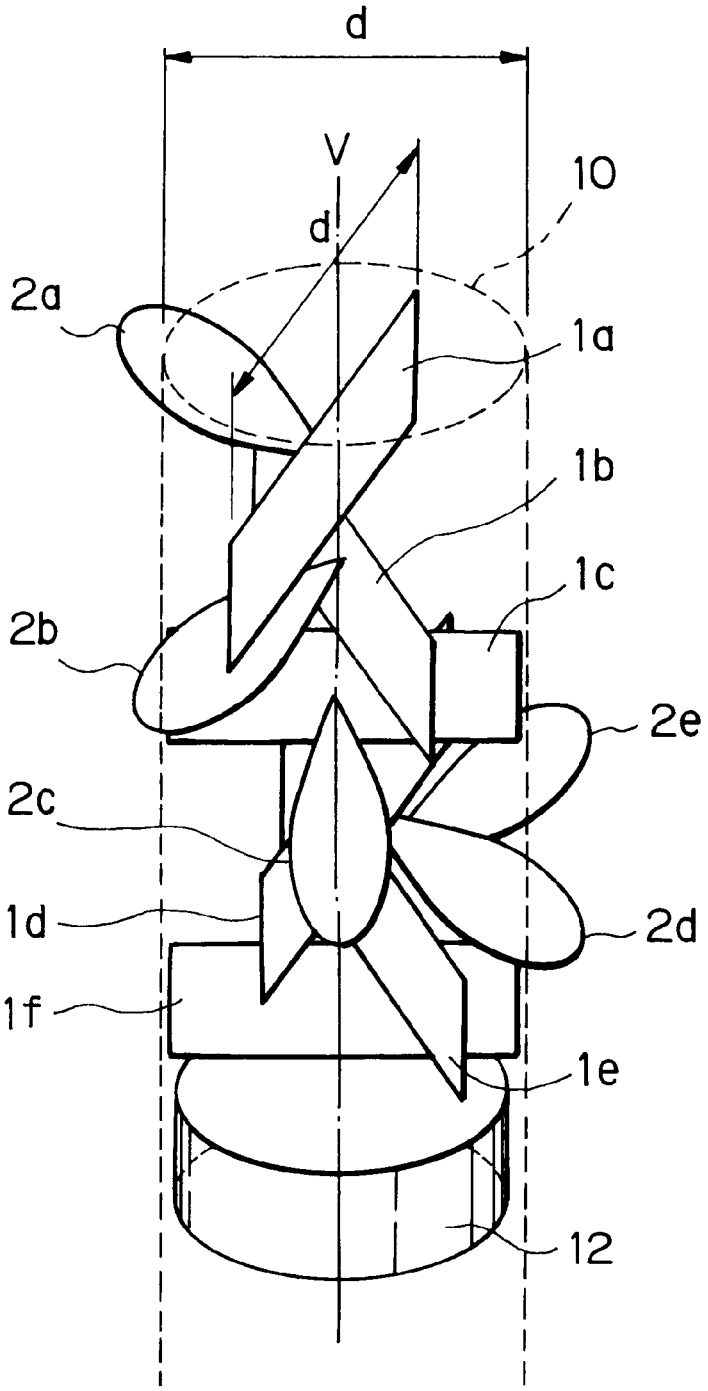
FIG. 1 shows structure of an embodiment of a multi sector antenna according to the present invention, FIGS. 2(*a*) and 2(*b*) show two cross sections of a multi sector antenna of FIG. 1.

FIG. 1 shows structure of an embodiment of a multi sector antenna according to the present invention, and shows a perspective view of a multi sector antenna covered by a radome. In the figure, a radome is shown by a dotted line, and members inside the radome are shown by solid line, for the sake of the explanation. The similar lines are used in other embodiments.

In FIG. 1, the numerals 1*a* through 1*f* show an element antenna which has horizontal length (d), 2*a* through 2*f* are a beam of the related element antenna, 10 is a cylindrical radome, and 12 is a sector switching circuit. It should be noted that only one of the beams 2*a*–2*f* is radiated at a time through switching of the beams 2*a* through 2*f*.

FIG. 1 shows the embodiment having six sectors so that six element antennas 1*a* through 1*f* provide six horizontal directivities in horizontal plane by six beams. Each element antenna provides different directivity from one another. Each element antennas are placed in vertical plane so that at least one of the element antennas is located at different height from that of other element antennas. In the embodiment of FIG. 1, the element antennas are stacked in vertical direction so that each element antenna is located at different height from one another and each element antenna does not overlap with another element antenna in vertical direction. Preferably, a center line of a plane of each element antenna coincides with a center line of a radome so that external diameter D of a multi sector antenna is minimized, in other words, a vertical axis V of the multi sector antenna is defined, and the element antennas are located with symmetrical relations concerning said axis V.

A cylindrical redome 10 covers said six element antennas. The vertical axis of the radome 10 coincides with the vertical axis V of the multi sector antenna. The inner diameter of the radome is d which is the same as the horizontal length of each element antenna. The radome operates not only for supporting element antennas, but also for protecting the antennas from rain, wind, and/or direct touch to the antenna by a man. The radome is made of dielectric material selected from teflon, polyethylene, FRP, and/or ABS.

A sector switching circuit 12 located in the radome is coupled with the element antennas 1*a* through 1*f* with a feed line, and with an external radio transceiver so that it selects one of the element antennas to switch beam direction. The sector switching circuit is for instance implemented by using a semiconductor switch such as a PIN diode, and/or an FET. Said feed line is implemented by a coaxial cable, a micro-strip line, and/or a wave-guide.

Figure 2A:
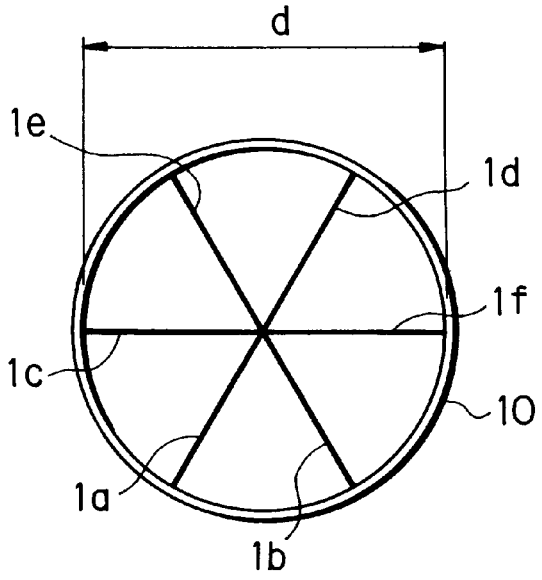
Figure 2B:
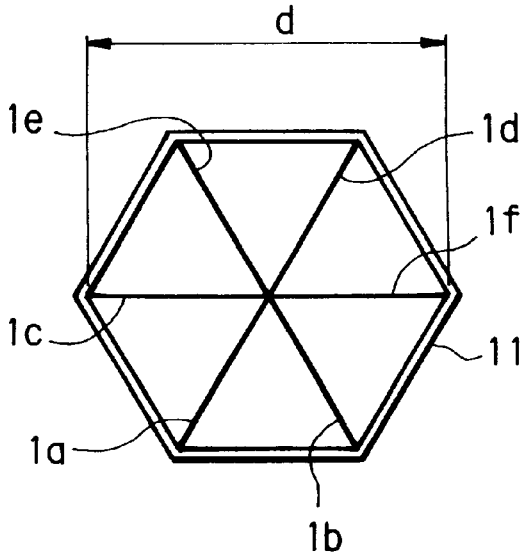

FIGS. 2(*a*) and 2(*b*) show two embodiments of cross section of the multi sector antenna of FIG. 1. FIG. 2(*a*) shows the embodiment that a radome is circular, and FIG. 2(*b*) shows the embodiment that a radome is in hexagonal prism.

The same numerals in FIGS. 2(*a*) and 2(*b*) show the same members as those in FIG. 1 and numeral 11 is a hexagonal radome.

It should be noted that each pair of element antennas 1*a* and 1*d*, 1*b* and 1*e*, and 1*c* and 1*f*, are located back-to-back so that each pair have opposite directivity (180°), and the top view is shown in FIGS. 2(*a*) and 2(*b*).

Figure 3:
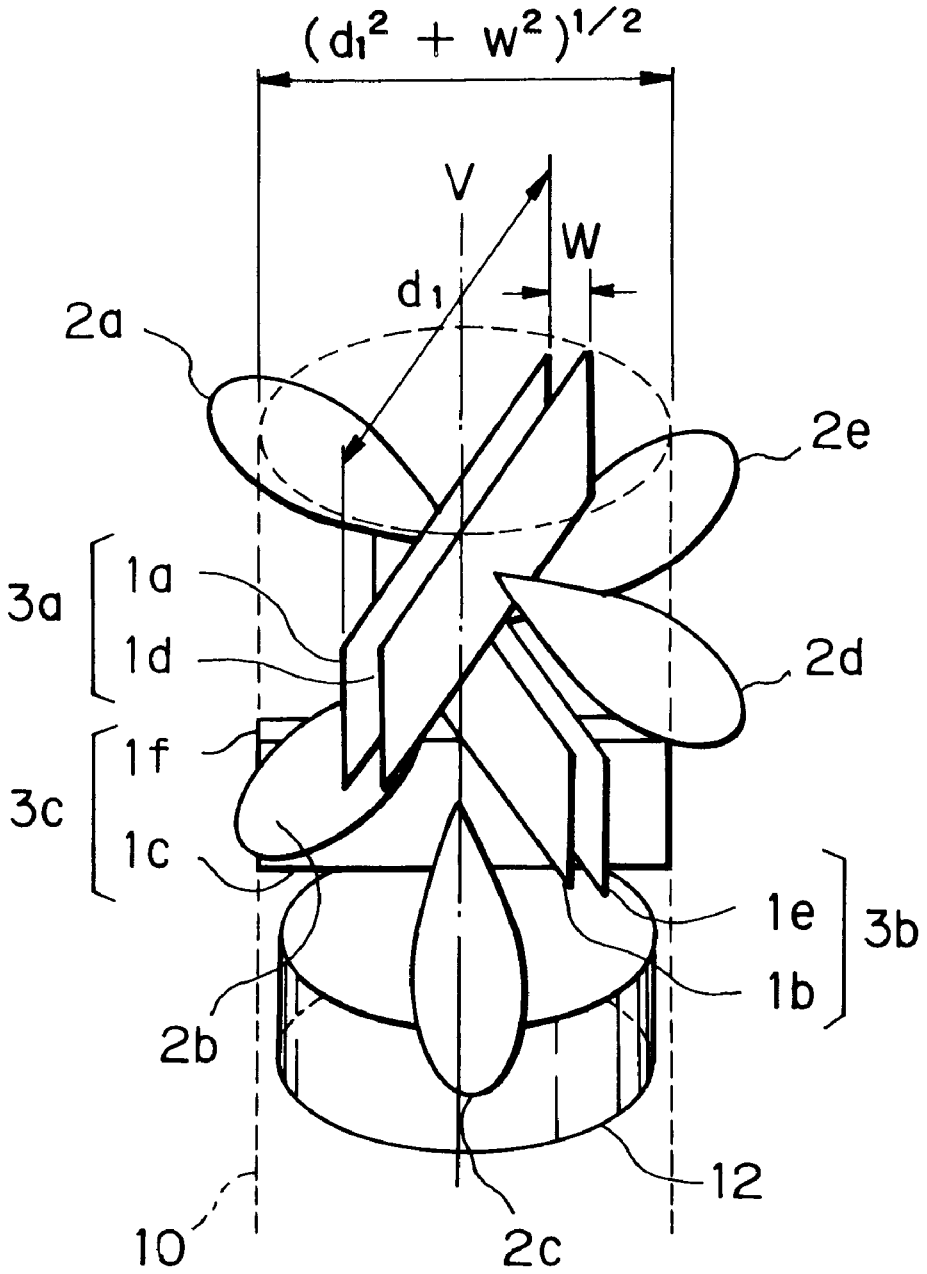
FIG. 3 shows structure of another embodiment of a multi sector antenna according to the present invention, FIGS. 4(*a*) and 4(*b*) show two cross sections of a multi sector antenna of FIG. 3.

In FIGS. 2(*a*) and 2(*b*), the center axis of each element antenna coincides with one another so that the external diameter D is as short as possible, FIG. 3 shows another embodiment of a multi sector antenna according to the present invention; and FIG. 3 shows a perspective view.

In FIG. 3, the numerals 3*a*–3*c* show a pair of element antennas, so that 3*a* shows a pair of element antennas 1*a* and 1*d*, 3*b* shows a pair of element antennas 1*b* and 1*e*, and 3*c* shows a pair of element antennas 1*c* and 1*f*. The numerals 2*a* through 2*f* show a beam by element antennas 1*a* through 1*f*, respectively.

FIG. 3 shows the embodiment that there are six element antennas each having horizontal length $d_1$, and different directivity in horizontal plane. Each pair of element antennas are positioned back-to-back with the spacing w so that first element antenna of the pair has the directivity in opposite direction (180°) with the second element antenna of the pair. The value W is far smaller than the value d. Three pairs 3*a*, 3*b*, 3*c*) of element antennas are positioned at three different heights so that the center of a pair of element antennas is in vertical plane, and coincides with the center of another pair of element antennas. A feed line to each element antenna may go through a back space having the width w behind an element antenna. The diameter of the sector antenna in FIG. 3 is small as the center of each pair coincides with the center of another pair.

A cylindrical radome 10 having the inner diameter $(d_1^2+w^2)^{1/2}$ covers three pairs of element antennas. The structure and the material of the radome are the same as those in FIG. 1.

It should be noted in FIG. 3 that a vertical center axis V is also defined, and the element antennas are positioned with symmetrical relations concerning said axis V.

A sector switching circuit 12 is coupled with each element antenna through a feed line so that one of the element antennas is selected according to electrical signal supplied by a radio transceiver; so that the desired beam direction is obtained. The sector switching circuit in FIG. 3 is similar to that in FIG. 1.

FIGS. 4(*a*) and 4(*b*) show a cross section of a multi sector antenna in FIG. 3. FIG. 4(*a*) shows the embodiment that a radome is in circular, and FIG. 4(*b*) shows the embodiment that a radome is in hexigonal. The numerals in FIGS. 4(*a*) and 4(*b*) are the same as those in FIG. 3 or FIG. 2.

Figure 5:
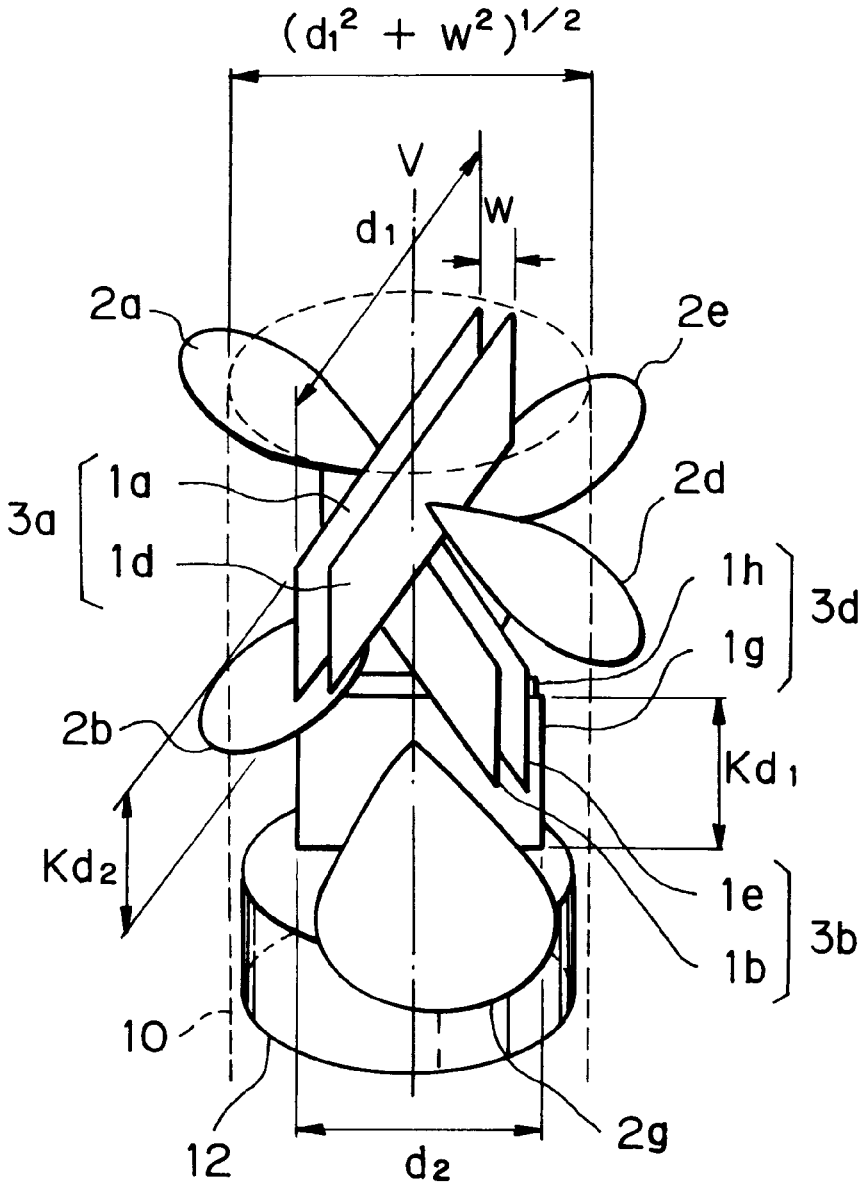
FIG. 5 shows structure of still another embodiment of a multi sector antenna according to the present invention.

FIG. 5 shows still another embodiment of the multi sector antenna according to the present invention. FIG. 5 shows a perspective view. In FIG. 5, the numerals 1*a*, 1*b*, 1*d*, 1*e*, 2*a*, 2*b*, 2*d*, 2*e*, 10 and 12 are the same as those in FIG. 3 or FIGS. 4(*a*) and 4(*b*). The numerals 1*g* and 1*h* are an element antenna, 2*g* is a beam by the element antenna 1*g*, and 3*d* shows a pair of the element antennas 1*g* and 1*h*.

In FIG. 5, four element antennas (1*a*, 1*d*, 1*b*, 1*e*) have the horizontal length $d_1$, and other two element antennas (1*g*, 1*h*) have the horizontal length $d_2$, where $d_2<d_1$. The area S ($=Kd_1d_2$) of each element antenna is the same as each other so that the maximum gain of each element antenna is the same as each other, where K is a constant defined by the desired antenna gain.

First pair (3*a*) has element antennas 1*a*, 1*d* each having the horizontal length $d_1$ and located back-to-back with the spacing w so that the directivity is opposite in horizontal plane, and the second pair (3*b*) has the similar structure to that of the first pair. A pair (3*d*) of element antennas (1*h*, 1*g*) having the horizontal length $d_2$ and located back-to-back with the spacing w so that the directivity is opposite in horizontal plane. Three pairs 3*a*, 3*b*, and 3*d* are positioned at three different heights so that the center of each pair coincides with the center of another pair, that is to says the vertical center axis V of the sector antenna is defined so that the element antennas are located with axial symmetry relating to the vertical center axis V. The diameter of the multi sector antenna is small as the center of each pair coincides.

A circular radome 10 having inner diameter $(d_1^2+w^2)^{1/2}$ is provided so that three pairs of element antennas are covered with the radome.

The sector switching circuit 12 is coupled with the element antennas 1*a*, 1*b*, 1*d*, 1*e*, 1*g*, and 1*h* through a feed line so that one of the beams is selected according to electrical signal from a radio transceiver (not shown).

In FIG. 5, the element antennas have the horizontal length $d_1$, and $d_2$, and the vertical length $Kd_2$, and $Kd_1$ so that the area S of each element antenna is constant, or the maximum gain of an element antenna is the same as each other. The value W is far smaller than the value $d_1$ or $d_2$.

Figure 6:
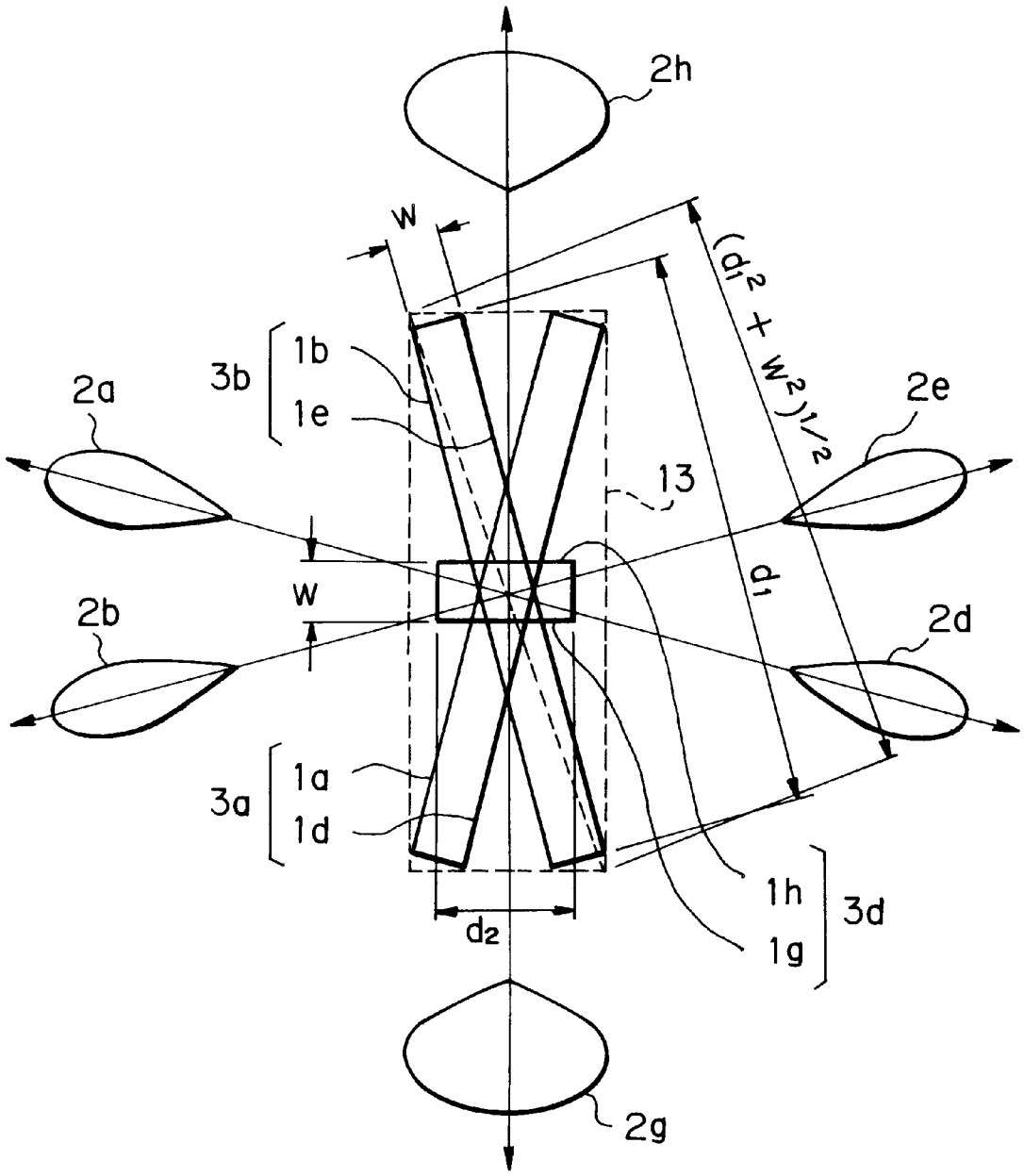
FIG. 6 shows a top view of still another embodiment of a multi sector antenna according to the present invention.

FIG. 6 shows a top view of still another embodiment of the sector antenna according to the present invention. In the figure, the same numerals show the same members as those in FIG. 5, and the numeral 13 is a cross section which is rectangular, of a cylindrical radome.

The feature of the multi sector antenna of FIG. 6 is that the ratio of $d_1$ and $d_2$ is large as compared with that of FIG. 5, and the angle between the pairs 3*a* and 3*b* differs from that of FIG. 5. Therefore, the cross section of the multi sector antenna in FIG. 6 is rectangular. The embodiment of FIG. 6 has the advantage that the antenna may be secured on the place where it is impossible to secure a circular redome or a regular polygonal radome.

Figure 7:
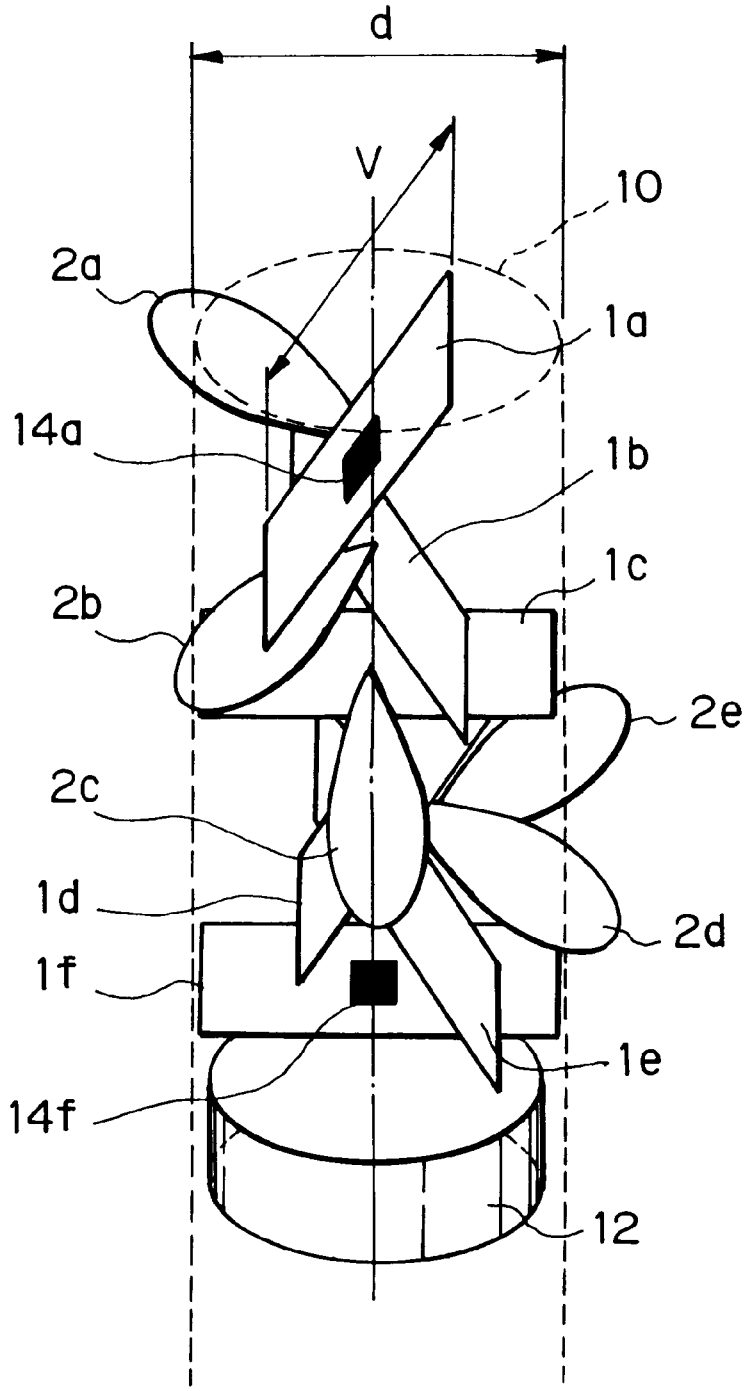
FIG. 7 shows structure of still another embodiment of a multi sector antenna according to the present invention, FIGS. 8(*a*), 8(*b*) and 8(*c*) show an embodiment of an element antenna used in the embodiment of FIG. 7, FIGS. 9(*a*) and 9(*b*) show structure of still another embodiment of a multi sector antenna according to the present invention, FIGS. 10(*a*) and 10(*b*) show an embodiment of an element antenna used in a present invention.

FIG. 7 shows a perspective view of the multi sector antenna of still another embodiment according to the present invention. In the figure, the numerals 14*a* and 14*f* are a high frequency circuit. Only high frequency circuits 14*a* and 14*f* are shown in the figure, although each element antenna 1*a* through 1*f* has a related high frequency circuit, since a high frequency circuit is located behind beam direction, and it is not seen in the figure except 14*a* and 14*f*. Other numerals in FIG. 7 are the same as those in the previous embodiments.

The structure of the multi sector antenna in FIG. 7 is the same as the structure of the multi sector antenna in FIG. 1, except for a high frequency circuit which includes an amplifier, a mixer circuit, a transmit/receive switching circuit, and/or a filter circuit, on an element antenna, or on a substrate which mounts an element antenna. One end of the high frequency circuit is connected to an element antenna, and the other end of the high frequency circuit is connected to a sector switching circuit.

Said high frequency circuit is implemented by a monolithic micro-wave millimeterand-wave integrated circuit (MMIC), or a micro-wave millimeterand-wave integrated circuit (MIC), or a hybrid integrated circuit (HIC).

Figure 8A:
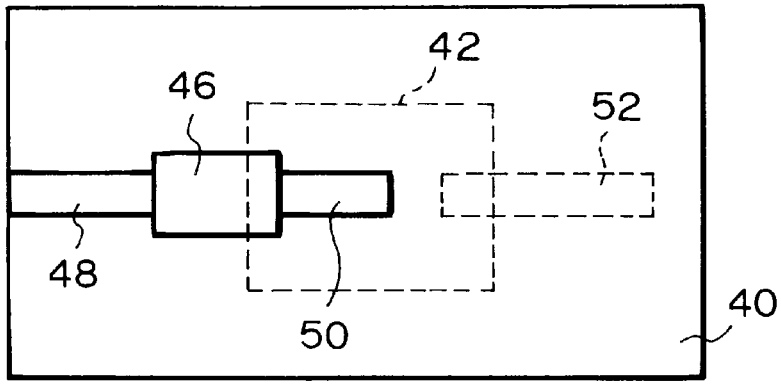
Figure 8B:
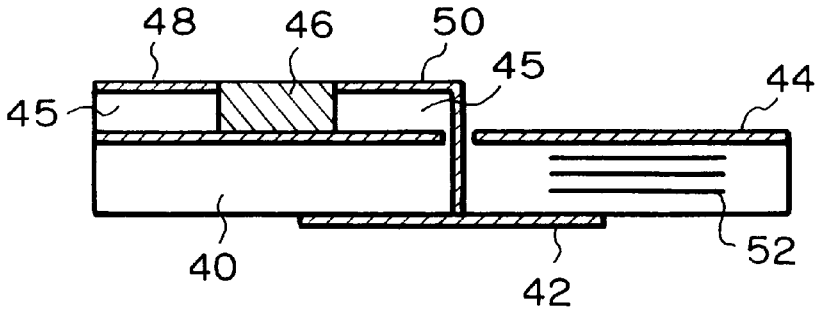
Figure 8C:
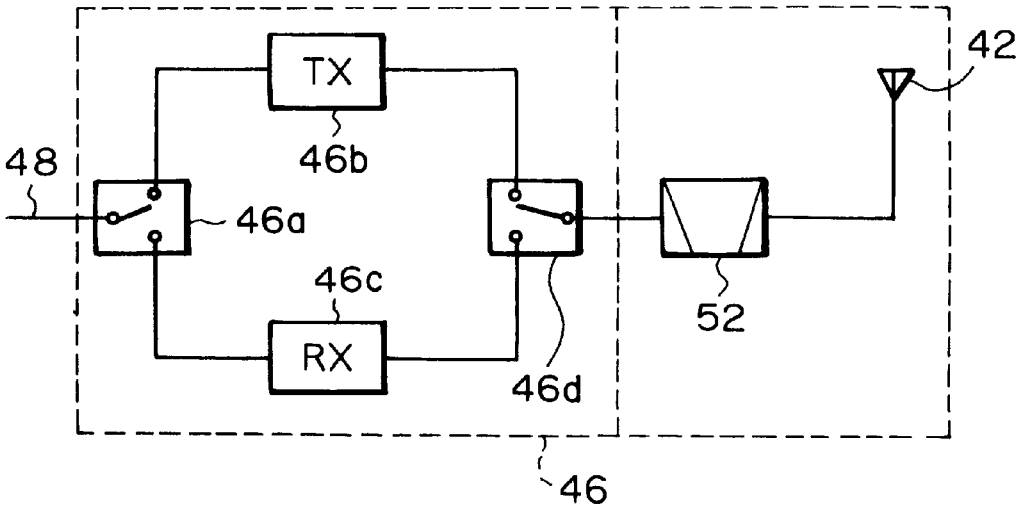

FIGS. 8(*a*) and 8(*c*) show an element antenna which mounts a high frequency circuit, used in the embodiment of FIG. 7.

In FIGS. 8(*a*) and 8(*c*), FIG. 8(*a*) shows a bottom view of an element antenna, FIG. 8(*b*) shows a cross section of FIG. 8(*a*), and FIG. 8(*c*) shows a circuit diagram of a high frequency circuit.

In FIGS. 8(*a*)–8(*c*) , the numeral 40 is a planar or flat disc-shaped dielectric substrate, 42 is a conductive patch mounted on one surface of the substrate 40. The patch 42 operates as an antenna, and the size of the patch is determined according to the operational frequency and the desired gain of the antenna. The numeral 44 is a ground conductor mounted on the other surface of the substrate. It should be appreciated that the substrate 40, the patch 42 and the ground conductor 44 constitute a micro-strip antenna The numeral 46 is a high frequency circuit mounted on the ground conductor 44, 48 is a feed line for coupling the high frequency circuit 46 with a sector switching circuit. The numeral 50 is a feed line for coupling an output of the high frequency circuit 46 with the micro-strip antenna through a filter 52. The feed lines 48 and 50 constitute another micro-strip line with the ground conductor 44 and another dielectric substrate 45 mounted on the ground conductor 44. The feed line 50 feeds the patch 42 through a hole on the ground conductor 44. The filter 52 which has inductive components and capacitive components are mounted in the substrate 40.

FIG. 8(*c*) shows a circuit diagram of the high frequency circuit 46, having a switch 46*a* coupled with a sector switching circuit by a feed line 48, a transmitter 46*b* and a receiver 46*c* coupled with said switch 46*a*, another switch 46*d* coupled with said transmitter and said receiver. The switches 46*a* and 46*d* operate simultaneously so that a transmitter or a receiver is selected. An output of the switch 46*d* is coupled with the antenna patch 42 through the filter 52 which removes undesired harmonics.

When the present multi sector antenna in the previous embodiments (FIGS. 1, 3, 5, 6) is used in a receiver, noise figure of a receiver will be deteriorated by several dB, since a sector switching circuit has an insertion loss by several dB. In the embodiment of FIG. 7 which has a high frequency circuit between an element antenna and a sector switching circuit, noise figure of a receiver is almost determined by noise figure of said high frequency circuit, and therefore, the noise figure (several dB) of the high frequency circuit is not added to the noise figure of the receiver.

On the other hand, when the conventional multi sector antenna is used in a transmitter, the output power of a transmitter is decreased by several dB, since a sector switching circuit has insertion loss by several dB. Therefore, conventionally, a transmitter provides higher output power by several dB to compensate the insertion loss. In the present invention in which a high frequency circuit is provided between an element antenna and a sector switching circuit, and a high frequency circuit is coupled directly with an element antenna, no high power amplifier for compensating insertion loss by a high frequency circuit is requested.

Figure 9A:
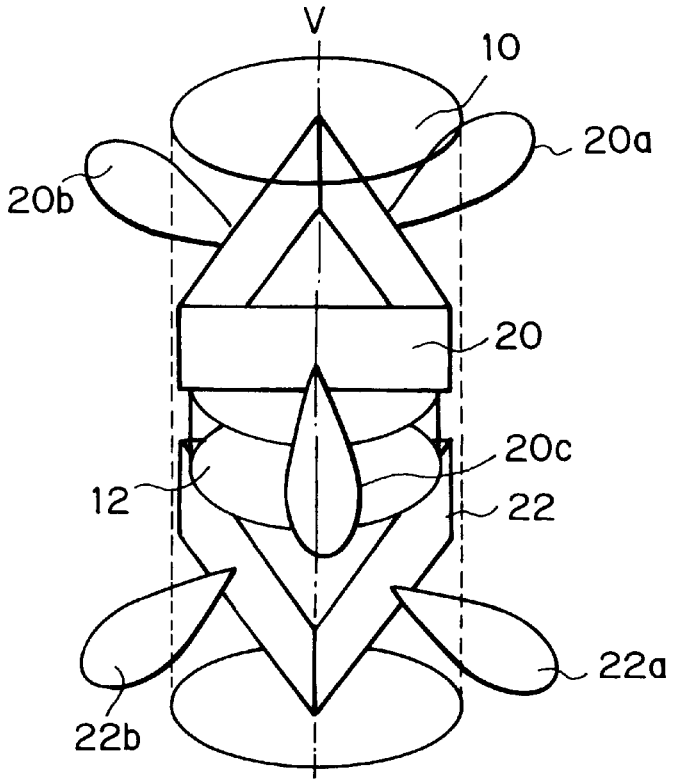
Figure 9B:
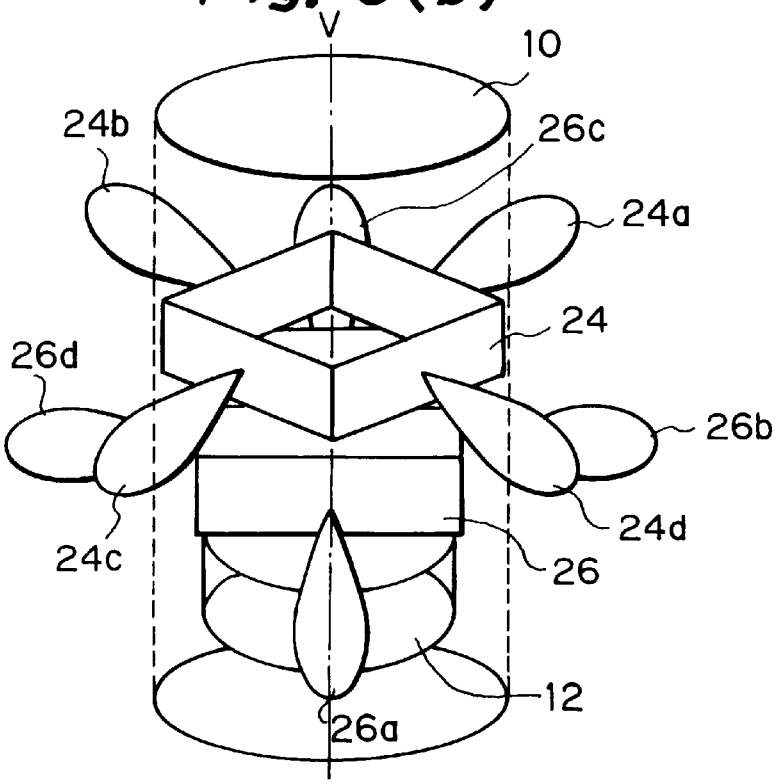

FIGS. 9(*a*) and 9(*b*) show some modifications of the multi sector antenna according to the present invention.

FIG. 9(*a*) shows the modification that at least three element antennas are arranged to equilateral triangle shape at the same height as one another so that the center of gravity of the triangle is on the vertical center axis V of the sector antenna.

FIG. 9(*b*) shows the modification that at least four element antennas are arranged to square at the same height as one another so that each element antennas are located with axial symmetric relation concerning the vertical center axis V of the sector antenna.

In each previous embodiments, preferably, element antennas are positioned with equal angular spacing for covering 360° of direction on horizontal plane, for instance, when N number of element antennas are used, the angular spacing is 360/N. Alternatively, if the gain or the horizontal length of each element antenna differs from one another, the angular spacing of element antennas may depend upon the gain of each element antennas.

Many modifications are possible to those skilled in the art. For instance, although an embodiment has six element antennas, and a radome has cross section of circular, regular hexagonal, or rectangular, the present invention is not restricted to that. Any number of element antennas, and any shape of cross section of a radome are possible in the spirit of the present invention. Further, each element antenna may have a plurality of micro-strip antennas, or a plurality of dipole antennas, although the embodiments show that each element antenna has only one micro-strip antenna.

As described above, element antennas in the present invention are stacked in vertical direction, therefore, the area of cross section of the multi sector antenna is small as compared with that of a prior multi sector antenna.

The present multi sector antenna may be used in a small portable terminal, a small portable transceiver, and/or a small portable information processing terminal.

When a high frequency circuit is secured on an element antenna, which is directly coupled with said high frequency circuit, noise figure of a receiver is lowered, and a transmitter with less output power is possible.

From the foregoing it will now be apparent that a new and improved multi sector antenna has been found. It should be understood of course that the embodiments disclosed are merely illustrative and are not intended to limit the scope of the invention. Reference should be made to the appended claims, therefore, rather than the specification for indicating the scope of the invention.

What is claimed is:

1. A multi sector antenna for radiating a single beam in desired direction, having a plurality of element antennas each having different directivity from one another in horizontal plane, comprising;

each element antenna being planar, each element antenna being located in vertical plane, at least one of the element antennas being positioned at different height from that of other element antennas, so that it does not overlap with other element antennas in vertical direction, a vertical axis (V) of said multi sector antenna being defined so that the element antennas are located with axial symmetrical relations relating to said axis.

2. A multi sector antenna according to claim 1, further comprising a cylindrical radome having the same vertical axis (V) covering all the element antennas.

3. A multi sector antenna according to claim 1, wherein all the element antennas are positioned in vertical planes including said vertical axis (V) with a predetermined angular spacing.

4. A multi sector antenna according to claim 1, wherein at least a first pair of the element antennas are positioned on the same height with each other back-to-back with spacing (w) so that a first element antenna of the pair has directivity opposite to that of a second element antenna of said pair, and other element antennas are located at different height from that of said first pair of element antennas.

5. A multi sector antenna according to claim 4, wherein a second pair of element antennas are positioned on the same height with each other back-to-back, but at different height from that of the first pair of element antennas, so that a first element antenna of the second pair has directivity opposite to that of a second element antenna of the second pair, and horizontal length ($d_1$) of the first pair of element antennas differs from horizontal length ($d_2$) of the second pair of element antennas.

6. A multi sector antenna according to claim 2, wherein horizontal cross section of said radome is in circular.

7. A multi sector antenna according to claim 2, wherein horizontal cross section of said radome is in polygonal.

8. A multi sector antenna according to claim 5, wherein ratio of horizontal length ($d_1$) of the first pair of element antennas to horizontal length ($d_2$) of the second pair of element antennas is inverse of ratio of vertical length of the first pair of element antennas to vertical length of the second pair of element antennas.

9. A multi sector antenna according to claim 1, further comprising a sector switching circuit for selecting one of the element antennas according to an external signal.

10. A multi sector antenna according to claim 1, wherein at least one of the element antennas has a related high frequency circuit on the same substrate as that of the element antenna.

11. A multi sector antenna according to claim 1, wherein an element antenna comprises at least a micro-strip antenna.

12. A multi sector antenna according to claim 10, wherein an element antenna is a micro-strip antenna having a dielectric substrate, a ground conductor on one surface of said substrate and a patch on the other surface of said substrate, and said high frequency circuit is mounted on said ground conductor on different side from that of said patch.

13. A multi sector antenna according to claim 1, wherein at least four of the element antennas are located so that those four element antennas form square.

14. A multi sector antenna according to claim 1, further comprising at least three element antennas located so that those three element antennas form equilateral triangle, and center of gravity of the triangle is on said vertical axis (V).

* * * * *